US010569127B2

(12) United States Patent
Lalaoua

(10) Patent No.: US 10,569,127 B2
(45) Date of Patent: Feb. 25, 2020

(54) CORE EXERCISE MACHINE

(71) Applicant: Nabile Innovations, LLC, Las Vegas, NV (US)

(72) Inventor: Nabile Lalaoua, Las Vegas, NV (US)

(73) Assignee: NABILE INNOVATIONS, LLC, Las Vegas, NV (US)

( * ) Notice: Subject to any disclaimer, the term of this patent is extended or adjusted under 35 U.S.C. 154(b) by 0 days.

(21) Appl. No.: 15/492,606

(22) Filed: Apr. 20, 2017

(65) Prior Publication Data

US 2017/0304676 A1 Oct. 26, 2017

Related U.S. Application Data

(60) Provisional application No. 62/391,111, filed on Apr. 20, 2016.

(51) Int. Cl.

| | |
|---|---|
| ***A63B 23/02*** | (2006.01) |
| ***A63B 21/00*** | (2006.01) |
| ***A63B 21/008*** | (2006.01) |

(52) U.S. Cl.

CPC .... *A63B 23/0222* (2013.01); *A63B 21/00069* (2013.01); *A63B 21/4035* (2015.10); *A63B 21/4049* (2015.10); *A63B 21/0083* (2013.01); *A63B 21/4039* (2015.10)

(58) Field of Classification Search

CPC ..... A63B 23/02–0205; A63B 23/0222; A63B 21/4049

See application file for complete search history.

(56) References Cited

U.S. PATENT DOCUMENTS

| | | | | |
|---|---|---|---|---|
| 5,607,374 A * | 3/1997 | Hesse | A63B 22/203 434/255 |
| 6,149,552 A * | 11/2000 | Chen | A63B 22/14 482/51 |
| 7,147,589 B2 * | 12/2006 | Chae | A63B 22/14 482/51 |
| 7,621,861 B1 * | 11/2009 | Kalember | A63B 22/14 482/146 |

(Continued)

FOREIGN PATENT DOCUMENTS

| | | |
|---|---|---|
| CN | 202219063 U | 5/2012 |
| WO | 2013/120436 A1 | 8/2013 |

OTHER PUBLICATIONS

International Search Report and Written Opinion of the International Searching Authority in International Patent Application No. PCT/US17/28576, dated Jul. 21, 2017.

*Primary Examiner* — Jennifer M Deichl
(74) *Attorney, Agent, or Firm* — Venable LLP

(57) ABSTRACT

An exercise machine for working core muscles includes a base, a handle bar connected to the base, and a leg support assembly connected to the base and extending substantially horizontally in a direction away from the handle bar. When one of the handle bar and leg support assembly is swung in a clockwise direction, the other of the handle bar and leg support assembly is swung in a counterclockwise direction, and when the one of handle bar and leg support assembly is swung in a counterclockwise direction, the other of the handle bar and leg support assembly is swung in a clockwise direction. The opposite direction rotations of the handle bar and leg support assembly create a double twist motion in the core muscles of a user of the machine.

8 Claims, 11 Drawing Sheets

(56) References Cited

U.S. PATENT DOCUMENTS

| | | | | |
|---|---|---|---|---|
| 7,901,329 | B2 * | 3/2011 | Tsai | A63B 22/14 482/115 |
| 2009/0149370 | A1 | 6/2009 | Moaddel et al. | |
| 2010/0184572 | A1 | 7/2010 | Wang | |
| 2012/0040812 | A1 | 2/2012 | Liao Lai | |
| 2016/0016038 | A1 * | 1/2016 | Maholmes | A63B 23/0211 482/127 |

* cited by examiner

CORE EXERCISE MACHINE

CROSS REFERENCE TO RELATED APPLICATION

This application claims the benefit of U.S. Provisional Patent Application No. 62/391,111, filed Apr. 20, 2016, the disclosure of which is incorporated by reference in its entirety.

BACKGROUND

Field of the Invention

The invention generally relates to a core exercise machine. More specifically, the invention relates to an exercise machine that induces a double twisting motion in a user in order to work core muscles.

Related Art

Generally speaking, the core of the body includes the muscles in the abdomen ("abs") and lower back, including the rectus abdominus and the oblique muscles, and also includes muscles in the mid back and hips. The core muscles are critical to balance and stability. Thus, the importance of training the core muscles to be strong and work together is well recognized.

When performing many exercises, it is important that the individual has a specific body alignment and moves in a specific way. If the body alignment and motion are not correct, the exercise may not be efficient and effective, or worse, the exercise could result in an injury. Body position and motion are of particular importance in core exercises, which work major muscles of the body. However, it can be difficult for an individual to perform the motions with the correct body position for effective core exercises without some sort of mechanical guidance. For example, one way to work the core muscles is to create a twisting movement in the core. But it can be hard for an individual to generate an effective twisting movement on his or her own without the aid of exercise equipment. Exercise machines have therefore been developed that target the core muscles. However, many of these exercise machines are large and expensive, and are therefore usually only practical for use in fitness centers and gyms. Further, even with some core exercise machines, the positioning of the individual on the machine and the motion induced by the machine are not optimal for working the core muscles.

U.S. Patent Application Pub. No. 2008/0207415 A1 and U.S. Pat. Nos. 7,901,329 B1 and 8,870,726 B2 show examples of twisting exercising machines. The machines described in these documents include two pivot assemblies, with one of the pivot assemblies being gripped by the user, and the other pivot assembly supporting the legs of the user. During exercise, users turn the pivot assemblies clockwise and counterclockwise. However, the pivot assemblies in the machines are not operatively connected to each other—each pivot assembly can pivot in either direction relative to the other pivot assembly. Thus, users are not directed by the machines to move the pivot assemblies in a particular clockwise or counterclockwise direction relative to each other.

U.S. Pat. No. 6,149,552 shows an example of a rowing and swimming exercise machine. The exercise machine includes a handle and a seat that can pivot in the same direction (clockwise or counterclockwise) or in opposite directions, with the pivoting parts of the machine being connected by a gear system. When using the exercise machine, the user is seated with his or her legs positioned towards the front of the machine. This positioning of the user may not allow the user to effectively work certain core muscles.

Thus, there is a need in the art for a core exercise machine that directs a user to optimally work the core muscles. In particular, there is a need in the art for an exercise machine that correctly positions a user and induces the user to twist in an effective and efficient manner that works core muscles.

SUMMARY OF THE INVENTION

According to one aspect, the invention provides an exercise machine having a base and a handle bar connected to the base. The handle bar includes a part extending upward from the base and a part to be gripped by a user. A leg support assembly is connected to the base and extends substantially horizontally in a direction away from the handle bar assembly, with the leg support assembly including at least one leg support surface configured to support the knees and parts of the shins of the user. The exercise machine is configured such that when one of the handle bar and leg support assembly is swung in a clockwise direction, the other of the handle bar and leg support assembly is swung in a counterclockwise direction, and when the one of handle bar and leg support assembly is swung in a counterclockwise direction, the other of the handle bar and leg support assembly is swung in a clockwise direction.

According to another aspect, the invention relates to an exercise machine including a base and a handle bar connected to the base. The handle bar includes a part extending substantially vertically from the base and a part to be gripped by a user. The exercise machine also includes a leg support assembly connected to the base and extending substantially horizontally in a direction away from the handle bar, with the leg support assembly including at least one leg support surface configured to support the knees and parts of the shins of the user. A connection mechanism is provided on the base, with the connection mechanism being configured such that when one of the handle and knee and leg support structure is swung in a clockwise direction, the other of the handle and knee and leg support structure is swung in a counterclockwise direction, and when the handle and knee and leg support structure is swung in a counterclockwise direction, the other of the handle and knee and leg support structure is swung in a clockwise direction.

According to yet another aspect, our invention relates to an exercise machine having a base including a gear assembly and a handle bar assembly extending upward from the base, with the handle bar assembly including at least surface to be gripped by a user. A leg support assembly extends from the base in a direction away from the handle bar assembly towards a rear of the machine, with the leg support assembly including at least support structure configured to support the knees and parts of the shins of the user with the feet of the user positioned at a rear of the machine. The gear assembly operatively connects the handle bar assembly and the leg support assembly such that (i) when the handle bar assembly or the leg support assembly is swung in a clockwise direction, the other of the handle bar assembly and the leg support assembly is swung in a counterclockwise direction, and (ii) when the handle bar assembly or the leg support assembly is swung in a counterclockwise direction, the other of the handle bar assembly and the leg support assembly is swung in a clockwise direction.

DETAILED DESCRIPTION OF THE INVENTION

The invention generally relates to an exercise machine for working core muscles. More specifically, the invention relates to an exercise machine that positions a user and induces a twisting motion in the user in order to create an effective and efficient core exercise. Specific embodiments of the invention will be described below. Those skilled in the art, however, will recognize many other alternative embodiments that fall within the scope of the invention.

Figure 1A:
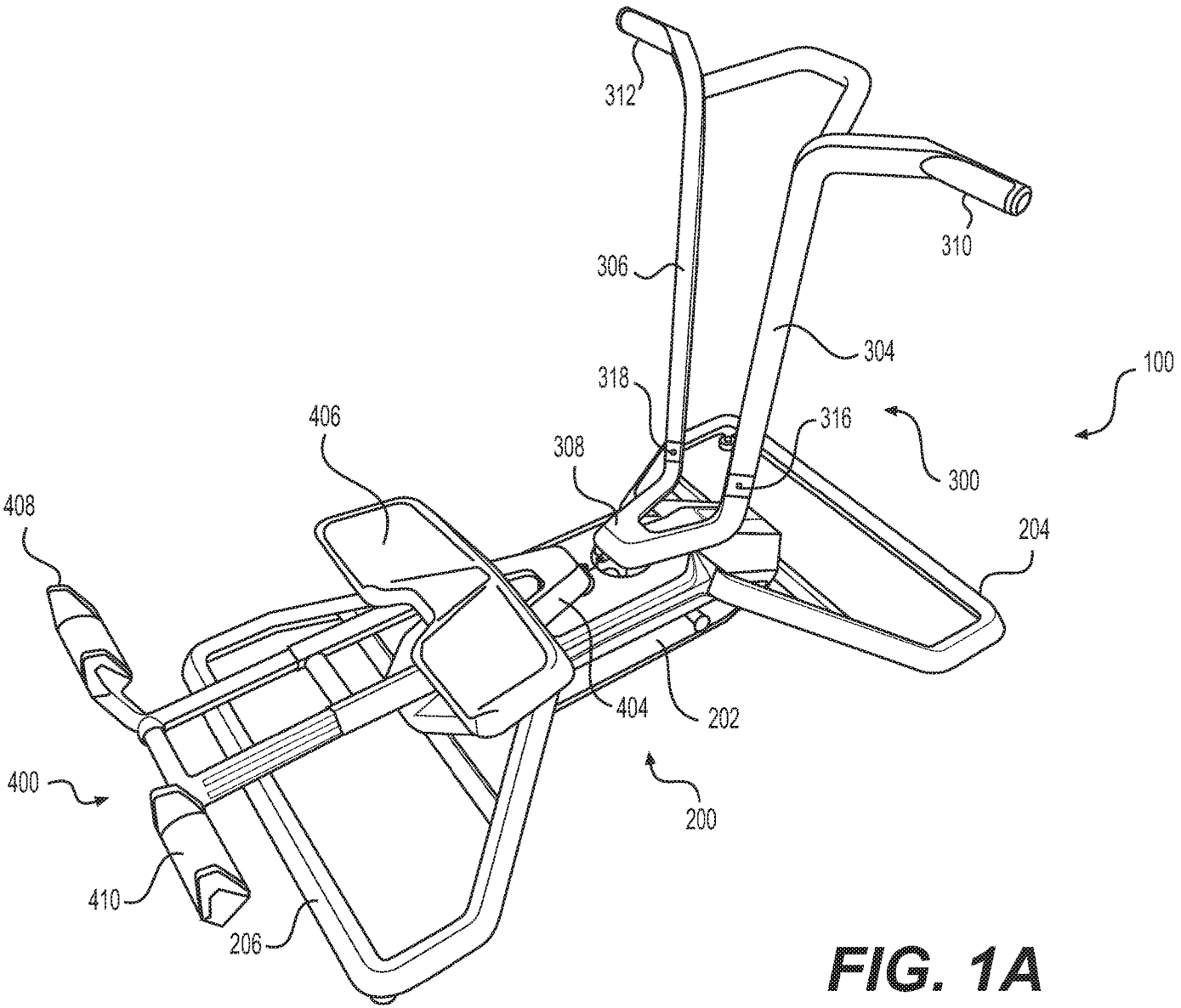
FIGS. 1A and 1B are views of an exercise machine according to a first embodiment of the invention.
Figure 1B:
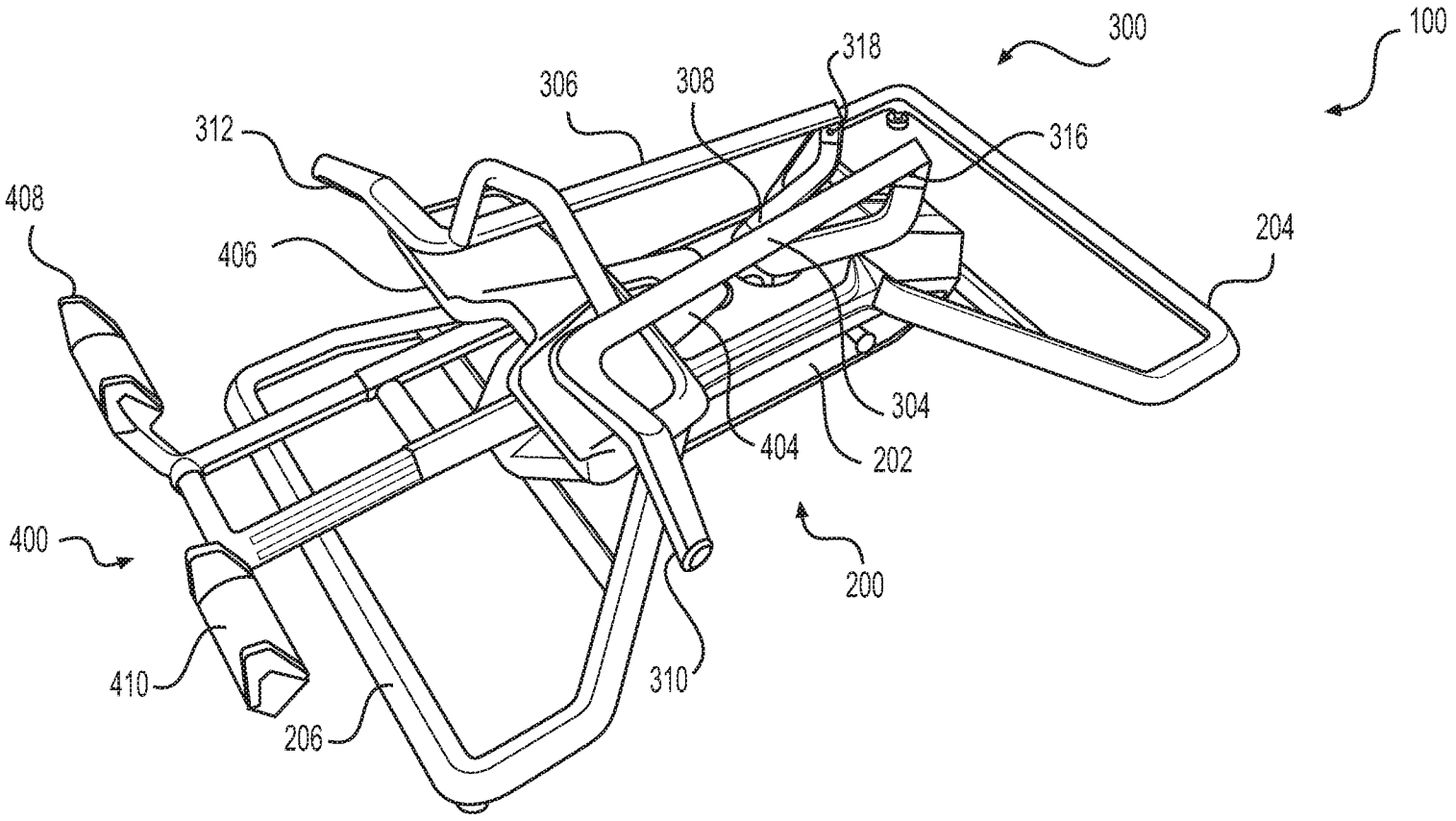

FIGS. 1A and 1B are views of a core exercise machine 100 according to a first embodiment of the invention. The machine 100 includes three parts systems: a base assembly 200, a handle bar assembly 300, and a leg support assembly 400. The handle bar assembly 300 extends upward from the base assembly 200 such that the parts to be gripped by the user are positioned towards a front end of the machine 100. The leg support assembly 400 extends from the base assembly in a direction away from base assembly 200 towards a rear of the machine 100. As will be described below, the relative positioning of the handle bar and leg support assemblies 300 and 400 directs the user to be optimally positioned for core exercise when using the machine 100.

The base assembly 200 includes a compartment 202 and supports 204 and 206. More specifically, the front support 204 extends from one side of the compartment 202 towards a front of the machine 100, and a rear support 206 extends from the opposite side of the compartment 202 towards a back end of the machine. The supports 204 and 206 are configured to provide a stable foundation for the exercise machine 100 on a floor or other surface. However, as will be appreciated by those skilled in the art, the supports 204 and 206 can take different forms from those shown in FIG. 1. For example, rather than having two supports 204 and 206 as shown in FIG. 1, the exercise machine 100 can be configured with four separate supports extending from each corner of the base assembly 200. Further, additional components could be attached to the supports 204 and 206, such as padding to prevent the supports 204 and 206 from slipping and scratching a floor.

The handle bar assembly 300 includes two parts 304 and 306 that extend upward from the base assembly 200. The parts 304 and 306 are connected at a joint 308 that is provided adjacent to the top of the compartment 202 of the base assembly 200, and a bar 314 connects the tops of parts 304 and 306. The joint 308 is attached to a connection axle rod, the details of which will be described below. The handle assemblies 304 and 306 include grips 310 and 312 that are grasp by the user of the machine 100. While a particular configuration with two parts 304 and 306 is shown in FIG. 1, those skilled in the art will appreciate the wide variety of alternative handle arrangements that could be used as part of an exercise machine as described herein. For example, in another embodiment the handle bar assembly 300 could include a T-shaped arrangement with first bar extending upwards from the base and a second bar extending perpendicular to the end of the first bar, with grips being provided at the ends of the second bar. An example of such an arrangement will be described below.

The two parts 304 and 306 of the handle bar assembly 300 include a telescoping and pivoting structures 316 and 318. With these structures, the handle bar assembly 300 can be lifted upwards and then pivoted to the position shown in FIG. 1B. When in the exercise machine 100 is placed in the configuration shown in FIG. 1B, the machine is compact and can therefore be easily stored.

The leg support assembly 400 extends in a substantially horizontal direction away from the handle bar assembly 300 towards a back end of the exercise machine 100. A joint 404 of the leg support assembly 400 is provided adjacent to the top of the compartment 202 of the base assembly 202 starting from a position next to the joint 308 of the handle bar assembly 300. Like the joint 308, the joint 404 is attached to a connection axle rod, the details of which will be described below. A kneepad 406 is provided on top of the joint part 404. The kneepad 402 may be fixed in one position on the joint 404, but, in other embodiments the kneepad 402 can be adjustably provided along the top of the joint structure 404 so as to movable towards and away from the handle assemblies 304 and 306. Two shin supports 408 and 410 extend from the joint 404 towards a rear of the machine 100. Together, the kneepad 406 and shin supports 408 and 410 are configured to support the legs of a user, as will be described below. Alternative leg support surfaces will also be described below. In another embodiment, the joint structure 404 can be made to have a telescoping arrangement or arrangements whereby the kneepad 402 and/or the shin supports 408 and 410 are adjustable in the horizontal direction.

Figure 2:
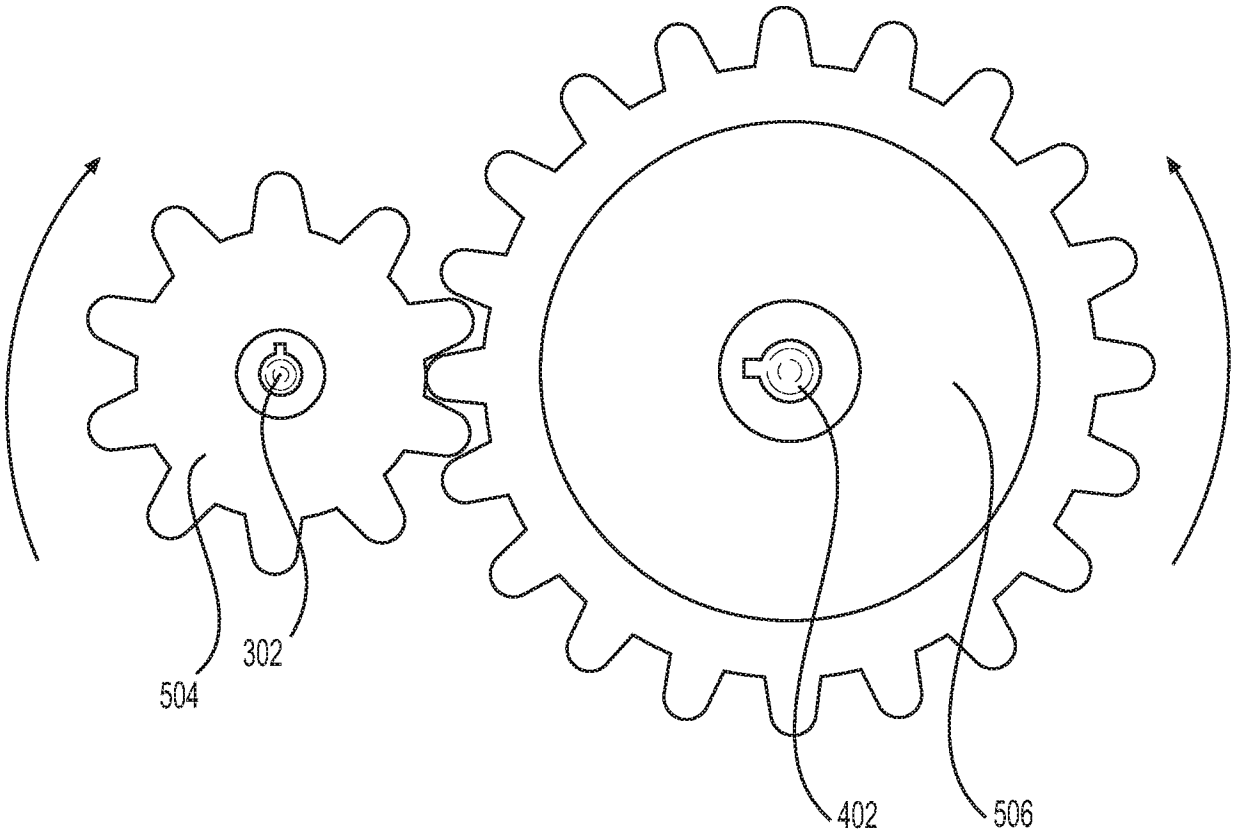
FIG. 2 is a detailed view of components of the exercise machine shown in FIG. 1.

The handle bar and leg support assemblies 300 and 400 are operatively connected within the compartment 202 such that the two assemblies 300 and 400 are made to swing in opposite directions relative to each other. FIG. 2 shows details of the operative connection between the handle bar and leg support assemblies 200 and 300 inside of the main body compartment 202. A first spur gear 504 is fixed to a connection axle rod 302 of the handle bar assembly 300, and a second spur gear 506 is fixed to a connection axle rod 402 of the leg support assembly. The teeth of the spur gears 504 and 506 mesh together such that the spur gears 504 and 506 rotate in opposite directions. For example, if the first spur gear 504 is rotated in a clockwise direction, then the second spur gear 506 is made to rotate in a counterclockwise direction. On the other hand, if the second spur gear 506 is made to rotate in a clockwise direction, then the first spur gear 504 will rotate in a counterclockwise direction. The connection axle rods 302 and 402 are fixed to the joints 308 and 404, respectively. Thus, through the spur gears 504 and 506 connection, the handle bar assembly 300 and the leg support assemblies are made to swing in opposite directions.

In the embodiment shown in FIG. 2, a gear ratio is provided such that the second spur gear 506 is larger than the first spur gear 504. Thus, a greater amount of torque must be applied to the second spur gear 506 to cause its rotation than amount of the torque that is required to rotate the first spur gear 504. This difference in torque following from the ratio of the first and second spur gears 504 and 506 is consistent with the relative strength that the user will be able to generate when using the machine 100. That is, humans naturally have more strength in their lower core muscles than their upper core muscle. As the second spur gear 506 is connected to the leg support assembly 400 while the first spur gear 504 is connected to the handle bar assembly 300, during use the user will need to ably a greater amount of torque to the leg support assembly 400 than to the handle bar assembly 300.

While the gear ratio depicted in FIG. 2 is conducive to a twisting core exercise as described herein, the invention should not be construed as limited to any particular gear ratio. Rather, the gear ratio may be selected in accordance with a desired resulting torque requirement, including cases where the spur gears 504 and 506 are the same size. Also, the spur gears 504 and 506 could be made in a variety of shapes and arrangements while still providing for the operative connection between the handle bar and leg support assemblies 200 and 300.

Those skilled in the art will also recognize alternative gear arrangements could be used in place of the spur gears 504 and 506, and further, other connection mechanisms could be used to replace the spur gears 504 and 506. For example, rather than having meshing gears, two separated gears could be used, with a chain being used to link the two gears. As another alternative, the spur gears 504 and 506 may include gear teeth around their complete circumference, but rather only include gear teeth around a part of the circumference through which two gears mesh during rotation of the handle bar and leg support assembly.

Figure 3A:
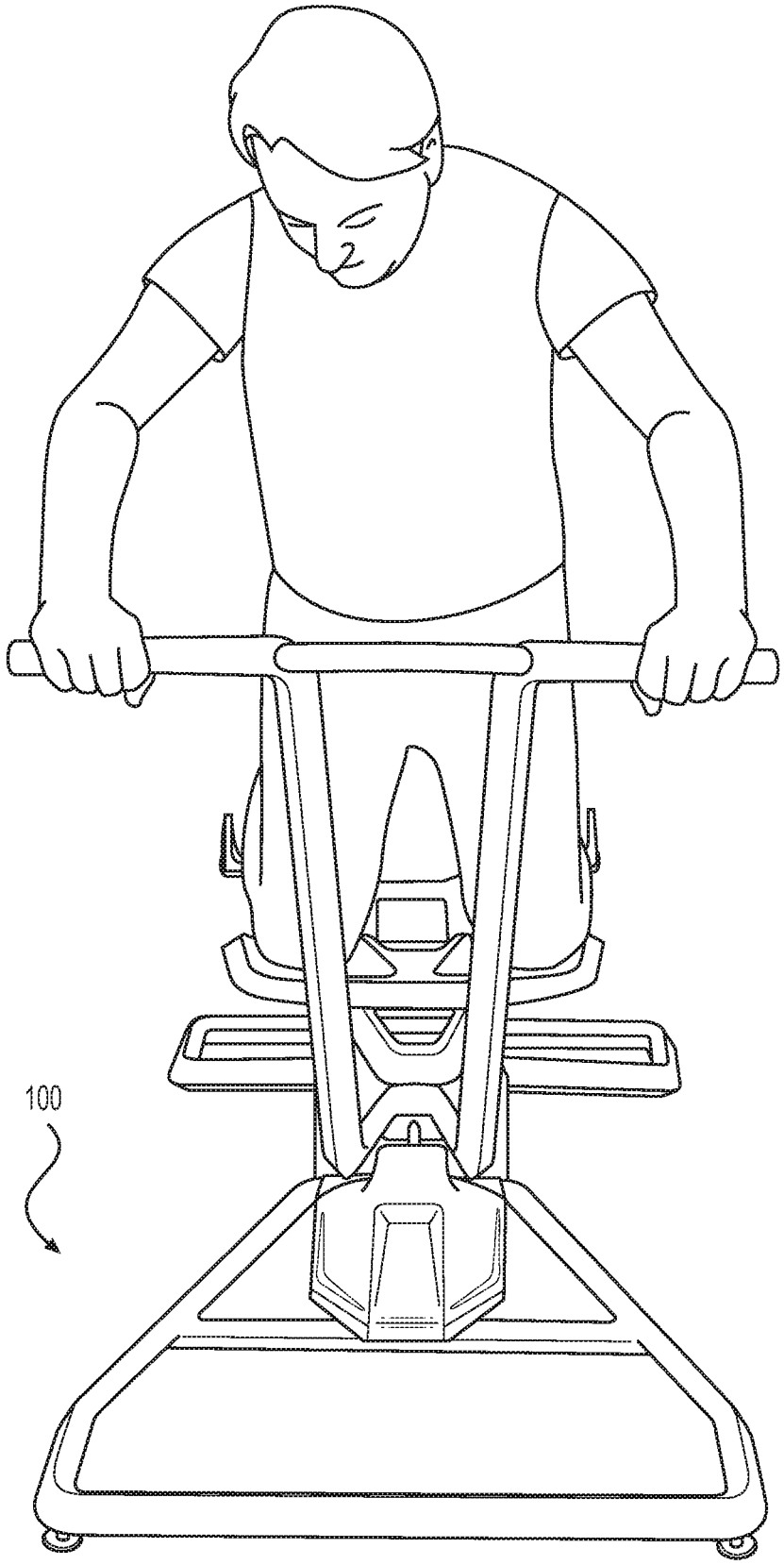
FIG. 3A is a view of the exercise machine shown in FIG. 1 with a user in the starting position.
Figure 3B:
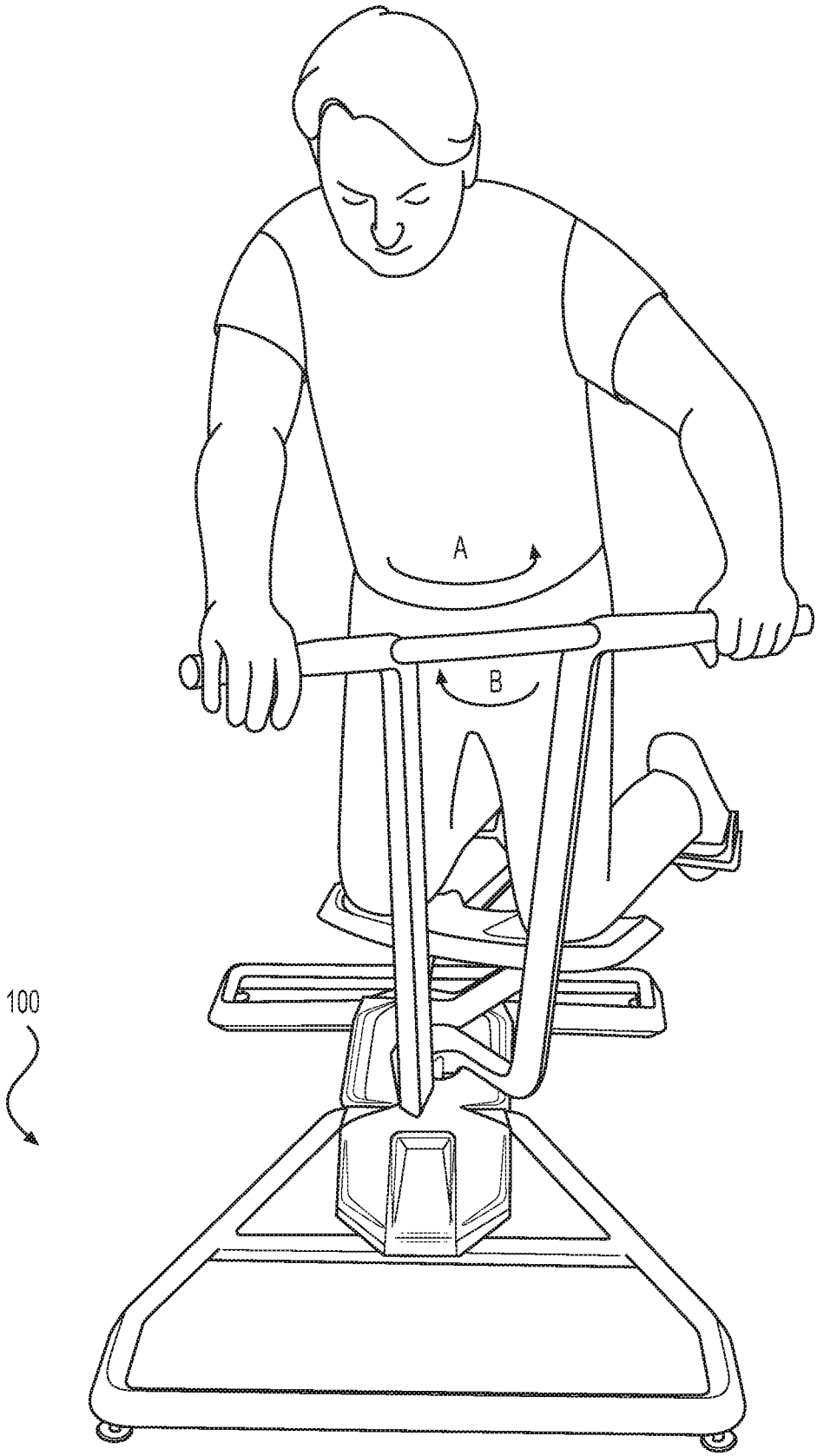
FIG. 3B is a view of the exercise machine shown in FIG. 1 twisted in one direction.
Figure 3C:
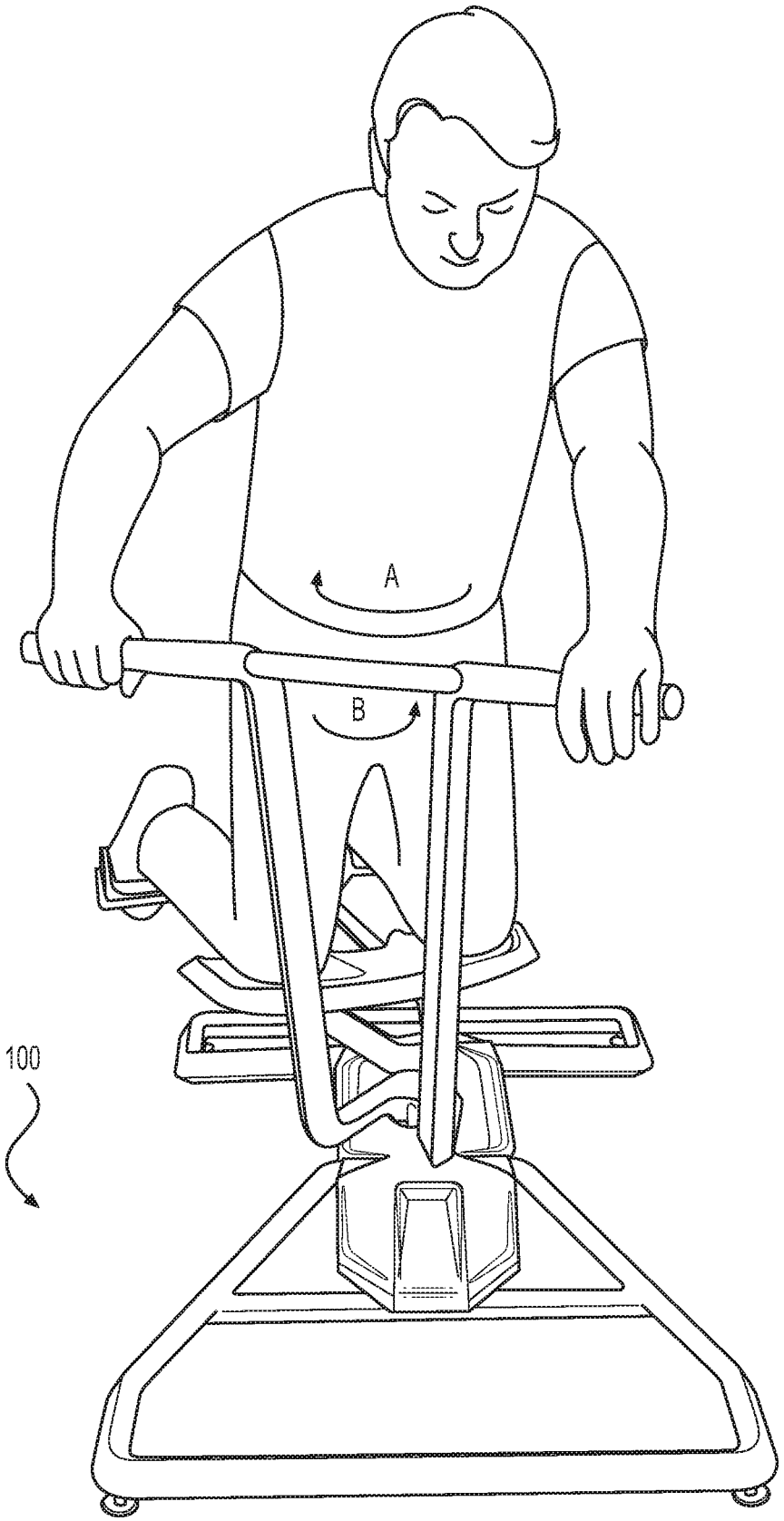
FIG. 3C is a view of the exercise machine shown in FIG. 1 twisted in a second direction.

The handle bar assembly 300 and the leg support assembly 400 together create a double twist motion in the core muscles when a user operates the machine 100. FIGS. 3A-3C show the double twist exercise generated by the machine 100.

The user starts the exercise with machine 100 by setting himself or herself in the position shown in FIG. 3A. In this starting position, the user's arms are extended forward with the user's hands placed on the grips 308 and 310 of the handle assemblies 304 and 306. The user's knees are bent and positioned on the kneepad 406, with parts of the user's shins being supported on the leg supports 408 and 410. The positioning of the arms, trunk, and legs of the user is optimal for core exercise as the core of the user is open towards the front of the machine and the core muscles can be twisted both clockwise and counterclockwise.

The user begins the exercise by using his or her core muscles to twist the handle bar and leg support assemblies 300 from the position shown in FIG. 3A to the position shown in FIG. 3B. More specifically, using his or her upper core muscles, the user 500 twists the handle bar assembly 300 in a counterclockwise direction, as denoted by the arrow A. While twisting to the position shown in FIG. 3B, the user 500 also twists his or her lower core muscles to pivot the lower body assembly 400 in a clockwise direction, as denoted by the arrow B. In effect, the core muscles of the user must perform a double twist, with the upper core muscles twisting in one direction, while the lower core muscles twist in the opposite direction. And the connection between the handle bar and leg support assemblies 300 and 400 provided within the base compartment 202 facilitates the opposite direction twisting motions by forcing the assemblies 300 and 400 to swing in opposite directions to one another. Further, as described above, the connection may be as such that user must apply more torque to the leg support assembly 400 than the handle bar assembly 300 during the motion from the starting position in FIG. 3A to the twisted position shown in FIG. 3B, which thereby causes the user to use more effort in his or her more powerful lower core muscles.

After moving to the position shown in FIG. 3B, the user reverses the twisting directions of his or her core muscles to move the handle bar and leg support assemblies 300 and 400 back to the starting position shown in FIG. 3A and to then to the position shown in FIG. 3C. When twisted to the position shown in FIG. 3C, the user's upper core muscles are twisted in a clockwise direction, as denoted by the arrow A, and the user's lower core muscles are twisted in the counterclockwise direction, as denoted by the arrow B. Thus, the same double twist in the user's core is achieved in the position shown in FIG. 3C as in the position shown in FIG. 3B, except that the direction of the twist in core muscles is different in the two positions.

After reaching the position in FIG. 3C, the user then reverses the twisting motion to move back through the starting position shown in FIG. 3A and then to the position shown in FIG. 3B. Through the duration of the exercise, the user the repeats the twisting motions back and forth between the positions shown in FIGS. 3B and 3C.

As a result of the positioning of the user on the machine 100 and the motion required to swing the handle bar and leg support assemblies 300 and 400 relative to each other, a highly efficient and effective core exercise is induced by the machine 100. In particular, the double twist motion effectively targets muscles throughout the core region. Further, the exercise can be strenuous when the user repeatedly performs the back and forth twisting motions on the machine 100. Thus, core muscle strength and flexibility can be improved with the use of the exercise machine 100, all the while also performing a cardio exercise.

Figure 4:
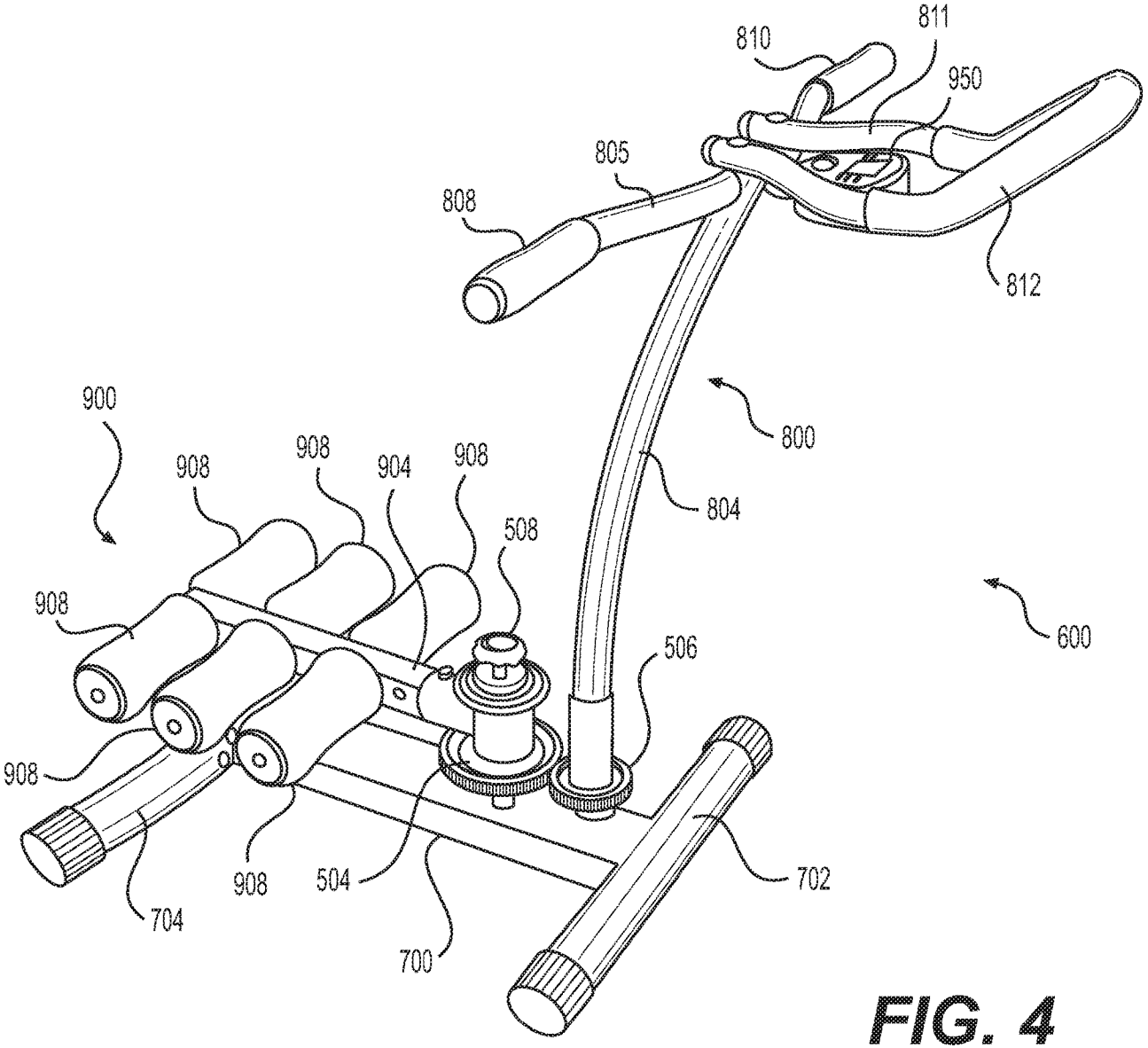
FIG. 4 is a view of an exercise machine according to another embodiment of the invention.

FIG. 4 shows an alternative embodiment of the invention. In this embodiment, the exercise machine 600 includes a base assembly 700, a handle bar assembly 800, and a leg support assembly 900. The supports 702 and 704 of the base assembly 700 provide a stable support for the machine 600 on a floor or other surface. As with the above-described embodiments, the handle bar assembly 700 and the leg support assembly 800 are connected using spur gears 504 and 506. In this embodiment, however, the base assembly does not include a compartment for containing the spur gears 504 and 506.

The handle bar assembly 800 of machine 600 includes an upward extending bar 804 and a cross bar 805 that is provided perpendicular to the end of the bar 804. Further, a curved bar 811 extends from the cross bar 805 towards the front of the machine 600. The handle bar assembly 800 provides two different positions for the user to operate the machine 600. In the first position, the user grasps the grips 808 and 810 at the ends of the cross bar 805. In the second position, the user grasps the grip 812 of the curved bar 811. The machine 600 therefore provides multiple options for users to position themselves during exercise, which may allow for more comfortable operation depending on a particular user.

The leg support assembly 900 of the machine 600 includes a joint bar 904 extending from the connection assembly towards a rear of the machine 600. A plurality of support rollers 908 extend from the sides of the joint bar 904. During use, the support rollers 908 function as leg support surface inasmuch as the user positions his or her knees and parts of his or her shins on the support rollers 908.

The exercise machine 600 functions in the same manner as the above described embodiments. That is, the user begins by grasping the handle bar assembly 800 and placing his or her legs on the leg support assembly 900. The handle bar assembly 800 and the leg support assembly 900 are then twisted in opposite clockwise and counterclockwise directions to create a double twist motion in the user's core muscles. The twisting motion is repeated back and forth to develop core strength and flexibility in conjunction with cardio exercise.

The embodiment shown in FIG. 4 also includes additional features to facilitate exercise with the machine 600. One feature is a monitor device 950 attached to the handle bar assembly 800. Those skilled in the art will recognize the wide variety of feedback that may be readily displayed on the monitor device 950, such as a timer or a counter that counts the number of twists performed by the user. Further, the monitor device 900 may work in conjunction with other devices, such as a monitor worn by the user so that the user's heart rate is displayed on the monitor 950. It should also be noted that a monitor could be provided with any of the embodiments of the exercise machine described herein as well.

Another feature of the machine 600 is a knob 508 that is operatively connected to the leg support assembly 900 and the spur gear 504. The knob 508 can be turned to increase or decrease the force required to swing the leg support assembly 900. More specifically, the knob 508 is swung to tighten or loosen a structure in cylinder 509 against the top of the spur gear 504. The structure could be, for example, a spring, disc, or a rubber cylinder. The tighter that the structure is pressed against the spur gear 504, the more force that is required to swing the leg support assembly 900. Thus, the knob 508 allows for adjustment in the difficulty of the core exercise performed with the machine 600. In alternative embodiments, resistance to swinging of the leg support assembly 900 and/or the handle bar assembly 800 could be provided by another adjustment mechanism. For example, a hydraulic cylinder could be attached to one of the assemblies 800 and 900 and the base assembly 700, with the hydraulic cylinder acting to create resistance to movement of the assemblies 800 and 900. Further, the resistance provided by the hydraulic cylinder could be made adjustable.

Figure 5:
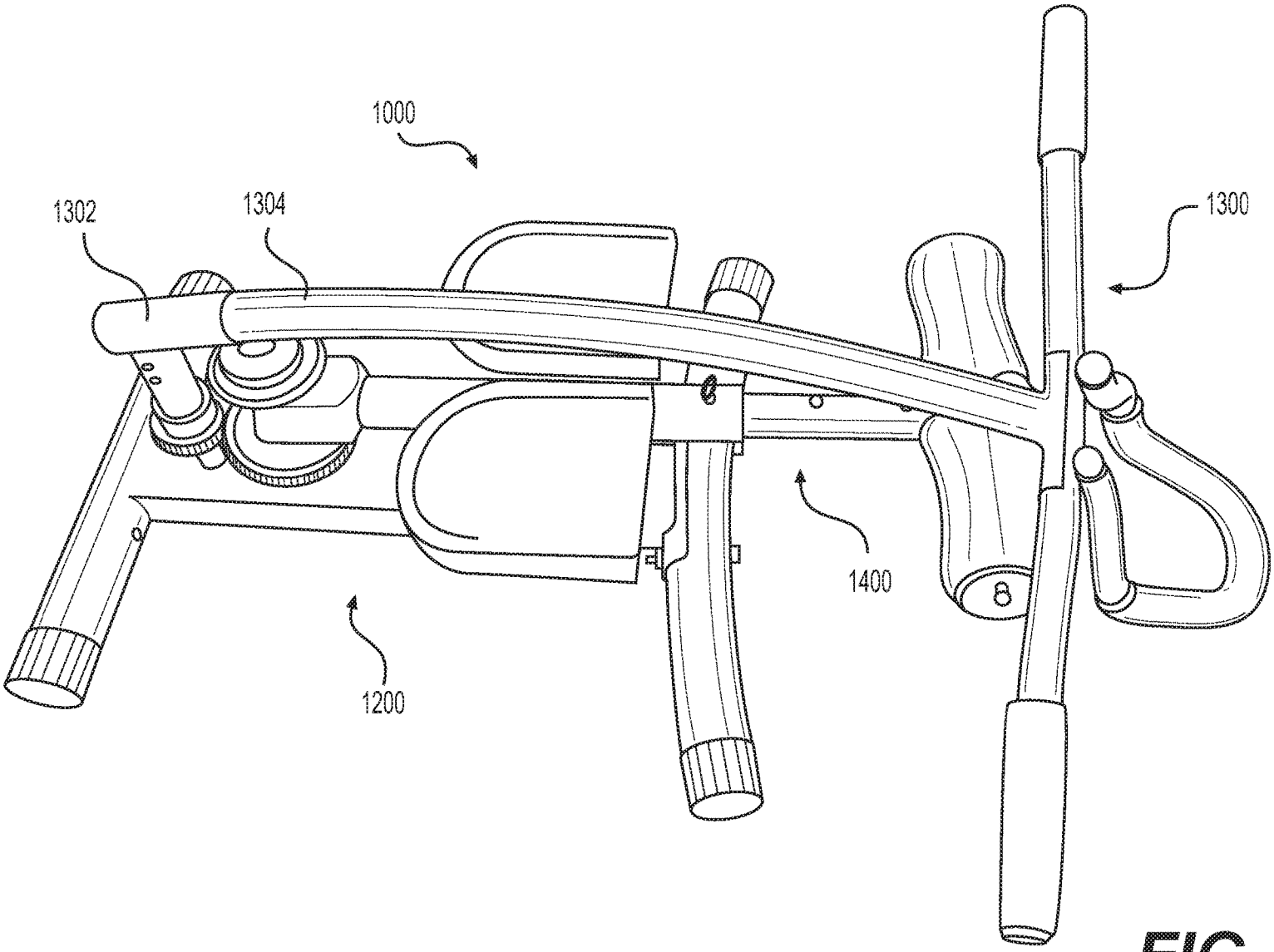
FIG. 5 is a view of the exercise machine according to yet another embodiment of the invention in a configuration to be stored.

FIG. 5 shows an exercise machine 1000 according to another embodiment of the invention. The exercise machine 1000 is otherwise similar to the embodiments described above. In this figure, however, the exercise machine 1000 is depicted in a compact storage position, with the handle bar assembly 1300 being positioned substantially parallel to the leg support assembly 1400. To move to the depicted position, the upward extending bar 1304 of the handle bar assembly 1300 pivots at a position 1302 between the upright position (not shown) wherein the exercise machine 1000 may be used, and the folded position shown in FIG. 5. Thus, when not in use, the exercise machine 1000 can be placed in a compact configuration for easy storage.

Figure 6A:
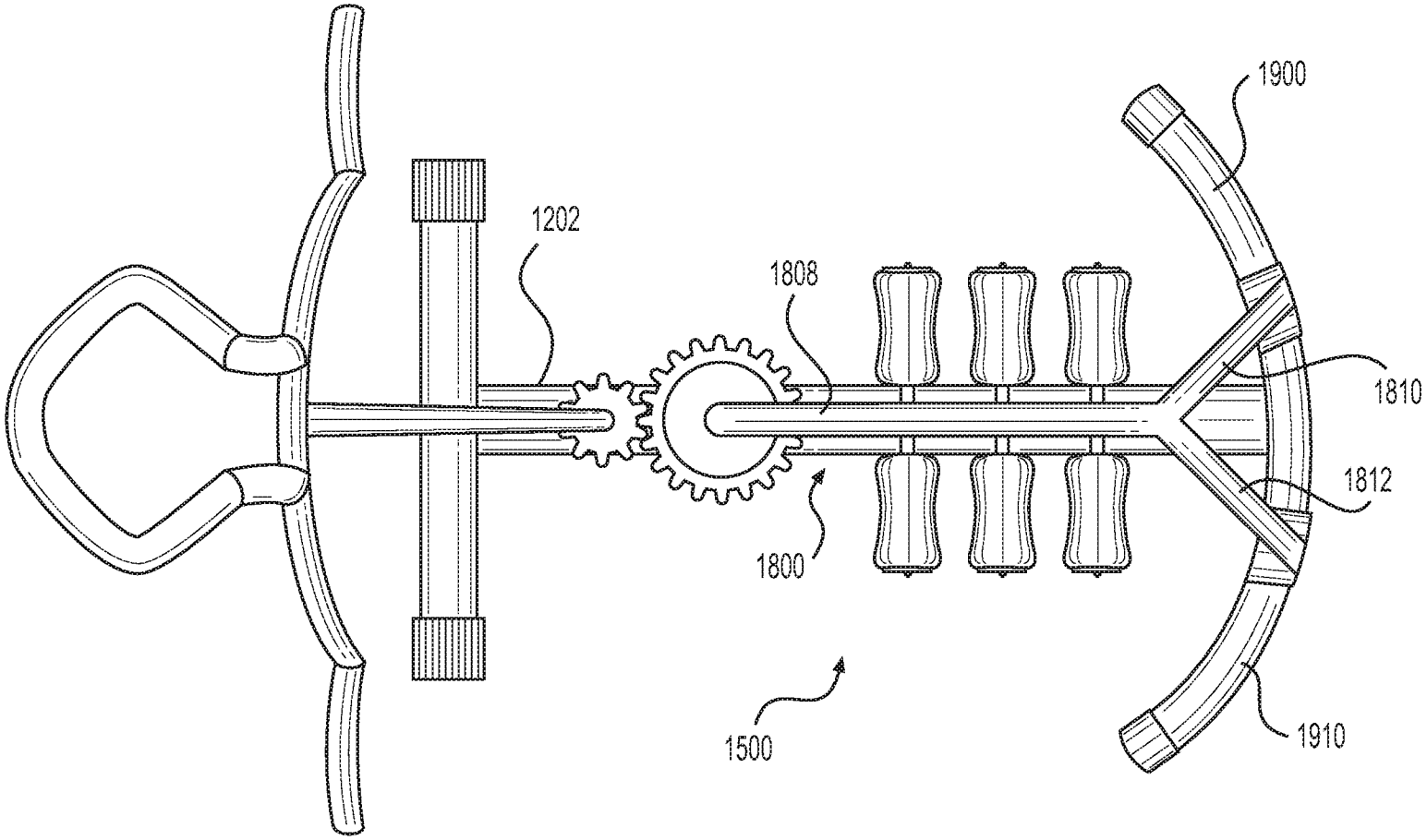
FIGS. 6A and 6B are views of an exercise machine according to another embodiment of the invention.
Figure 6B:
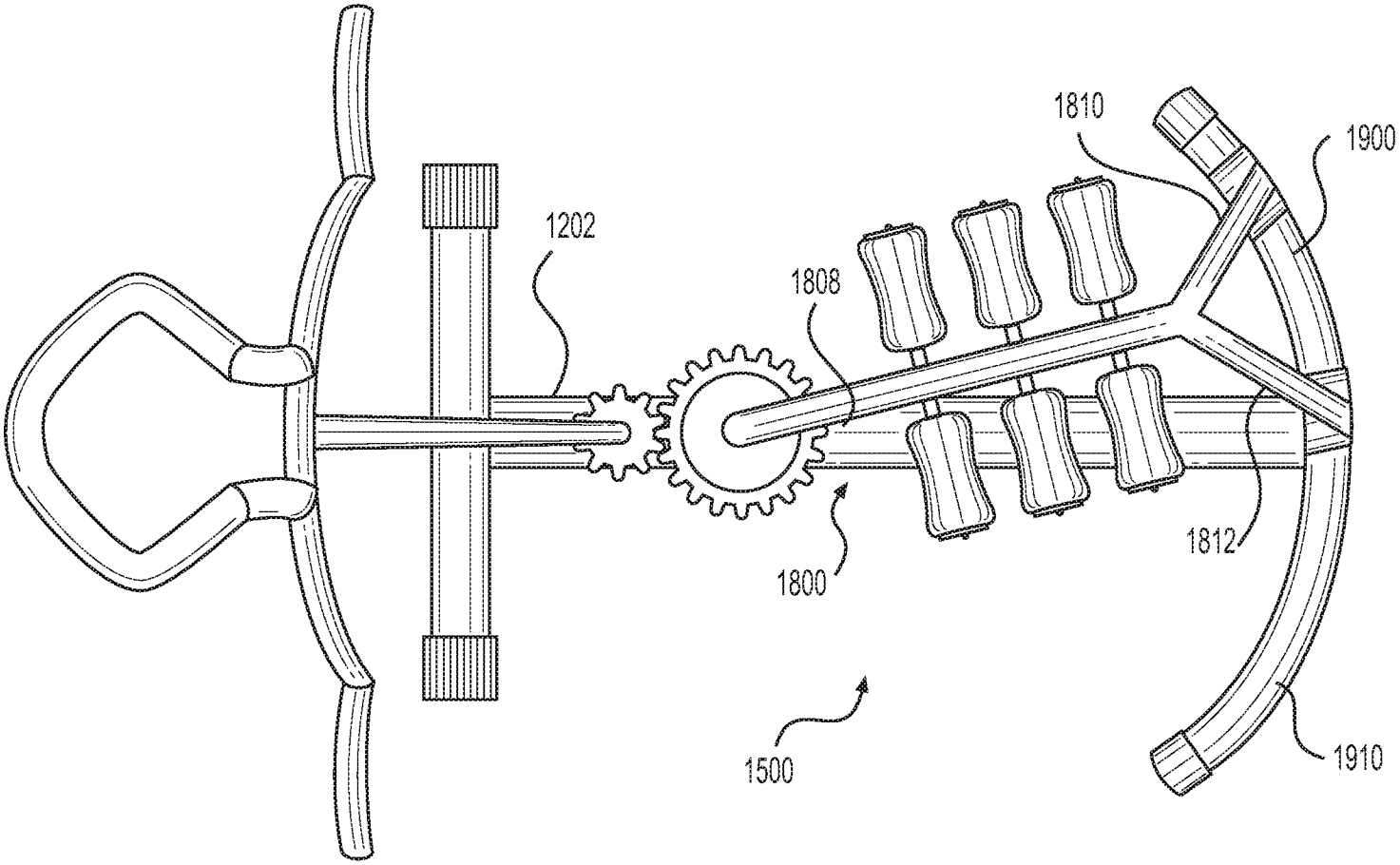

FIGS. 6A and 6B are views of an exercise machine 1500 according to yet another embodiment of the invention. The exercise machine 1500 is similar to the exercise machines described above, except that the back end of the exercise machine 1500 is modified. In particular, at the back end of the exercise machine 1500 the base assembly 1600 includes a rail 1900 that is connected by a cross bar 1902 to the front end of the base assembly 1600. Two support bars 1810 and 1812 extend from the back end of the joint bar 1808 of the leg support assembly 1800. At the ends of the support 1810 and 1812 are rollers 1814 and 1816 that follow a track formed by the top of the rear support rail 1900. As the leg support assembly 1800 is twisted from the position shown in FIG. 6A to the position shown in FIG. 6B, the rollers 1814 and 1816 move along the rear support rail 1900. After the leg support assembly 1800 is swung to the furthest extent in one direction (FIG. 6B), its direction is reversed and the rollers 1814 and 1816 follow the rail to position where the leg support assembly is swung to the furthest extent in the other direction. Note, in this embodiment, the support rail 1900 takes the place of the rear supports of the base assembly that are provided in other embodiments of the invention. And, as the support rail 1900 supports the support bars 1810 and 1812 of the leg support assembly 1800, the leg support assembly 1900 is firmly supported in the machine 1500.

Figure 7:
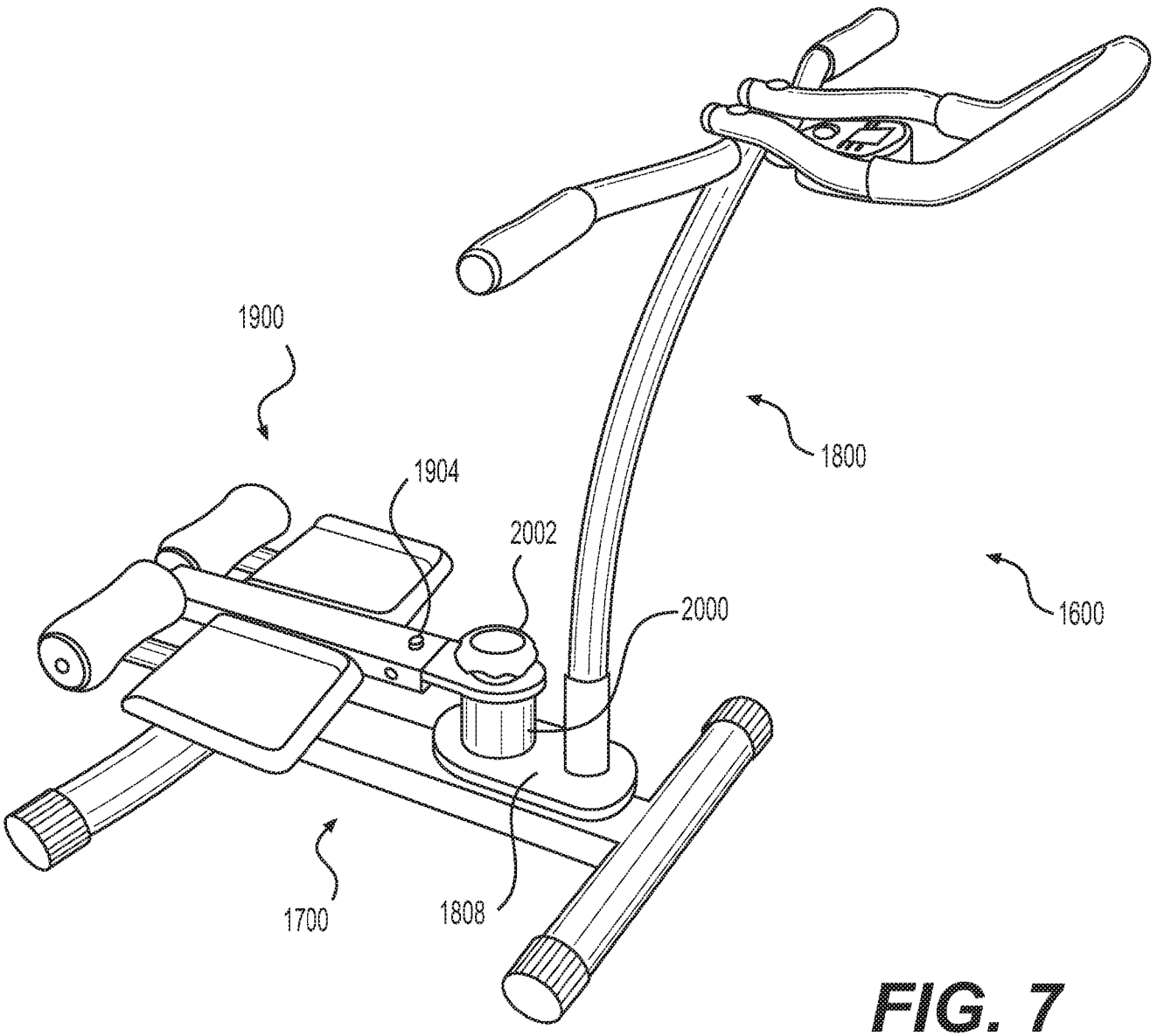
FIG. 7 is a view of an exercise machine according to yet another embodiment of the invention.

FIG. 7 shows an exercise machine 1600 according to yet another embodiment of the invention. The exercise machine 1600 includes a base assembly 1700, a handle bar assembly 1800, and a leg support assembly 1900, which are similar to the assemblies in the above described embodiments. In this embodiment, however, a rubber block 2000 is provided between the handle bar assembly 1800 and the leg support assembly 1900, with a top end of the rubber block 2000 contacting the joint part 1904 of the leg support assembly 1900 and a bottom end of the rubber block 2000 contacting the joint part 1808 of the handle bar assembly 1800. An axle rod (not shown) is connected to a tension knob 2002 and the base assembly 1700, and the tension knob 2002 is positioned against a part of the joint part 1904. The axle rod extends through the joint part 1904, through the rubber block 2000, and through the joint part 1808, with the handle bar assembly 1800 and the leg support assembly 1900 being swingable about the axle rod. By rotating the tension knob 2002 about the end of the axle rod, the handle bar assembly 1800 and the leg support assembly 1900 are tightened to, or loosened from, the rubber block 2000. Thus, the force required to swing the handle bar assembly 1800 and the leg support assembly 1900 is adjusted through the tension knob 2002.

Although this invention has been described in certain specific exemplary embodiments, many additional modifications and variations would be apparent to those skilled in the art in light of this disclosure. It is, therefore, to be understood that this invention may be practiced otherwise than as specifically described. Moreover, it will be understood by those skilled in the art that the specific embodiments described herein may be combined in different ways, for example, a part of one embodiment may be combined with a part from another embodiment. Thus, the exemplary embodiments of the invention should be considered in all respects to be illustrative and not restrictive, and the scope of the invention to be determined by any claims supportable by this application and the equivalents thereof, rather than by the foregoing description.

INDUSTRIAL APPLICABILITY

The invention can be used in production of a machine used to exercise core muscles. Thus, the invention is applicable to the exercise equipment industry.

The invention claimed is:

1. An exercise machine comprising:

a base;

a handle bar connected to the base, the handle bar including a part extending substantially vertically from the base and at least one part to be gripped by a user; and a leg support assembly connected to the base and extending substantially horizontally in a direction away from the handle bar, the leg support assembly including at least one leg support surface configured to support the knees and parts of the shins of the user; and a connection mechanism provided on the base, the connection meshing including spur gears that mesh together, and with a rotatable knob operatively connected to one of the spur gears, the connection mechanism being configured such that:

(i) when one of the handle and the knee and leg support structure is swung in a clockwise direction, the other of the handle and the knee and leg support structure is swung in a counterclockwise direction, and a user's upper body and the user's lower body are both rotated towards one side of the exercise machine, (ii) when the handle and the knee and leg support structure is swung in a counterclockwise direction, the other of the handle and the knee and leg support structure is swung in a clockwise direction, the user's upper body and the user's lower body are both rotated towards a second side of the exercise machine, and (iii) rotation of the knob in one direction increases a force required to swing the handle and the knee and leg support structure, and rotation of the knob in an opposite direction decreases a force required to swing the handle and the knee and leg support structure.

2. An exercise machine according to claim 1, wherein the base includes a compartment containing the connection mechanism.

3. The exercise machine according to claim 1, wherein the leg support surface includes a knee pad configured to support the knees of the user and at least one shin support pad configured to support the shins of the user.

4. An exercise machine according to claim 3, wherein the support structure includes two shin support pads configured to support the shins of the user.

5. An exercise machine comprising:

a base including a gear assembly, the gear assembly including a first spur gear meshing with a second spur gear;

a curved handle bar assembly extending upward from the first spear gear and in a horizontal direction towards a front of the exercise machine, the handle bar assembly including two parts to be gripped by a user, with the two parts being positioned closer to the front of the exercise machine than the first spur gear is to the front of the exercise machine;

a leg support assembly connected to the second spur gear and extending in a direction away from the handle bar assembly towards a rear of the machine such that the entirety of the leg support assembly is positioned behind the second spur gear, the leg support assembly including at least support structure configured to support the knees and parts of the shins of the user with the feet of the user positioned at a rear of the machine, and the leg support assembly being configured to swing about a point positioned directly above the second spur gear; and a rotatable knob extending upwardly from the second spur gear, wherein the gear assembly operatively connects the handle bar assembly and the leg support assembly such that (i) when the handle bar assembly or the leg support assembly is swung in a clockwise direction, the other of the handle bar assembly and the leg support assembly is swung in a counterclockwise direction, and the handle bar and leg support assembly are both moved towards one side of the device, and (ii) when the handle bar assembly or the leg support assembly is swung in a counterclockwise direction, the other of the handle bar assembly and the leg support assembly is swung in a clockwise direction, and the handle bar and leg support assembly are both moved towards a second side of the device that is opposite to the first side, and wherein rotation of the knob in one direction increases the force required to swing the handle bar assembly and the leg support assembly, and rotation of the knob in an opposite direction decreases the force required to swing the handle bar assembly and the leg support assembly.

6. An exercise machine according to claim 5, wherein the base includes a compartment containing the gear assembly.

7. The exercise machine according to claim 5, wherein the leg support surface includes a knee pad configured to support the knees of the user and at least one shin support pad configured to support the shins of the user.

8. An exercise machine according to claim 5, wherein the support structure includes two shin support pads configured to support the shins of the user.

* * * * *